US007700868B2

(12) United States Patent
Suzuki

(10) Patent No.: US 7,700,868 B2
(45) Date of Patent: Apr. 20, 2010

(54) MUSICAL INSTRUMENT AND SUPPORTING SYSTEM INCORPORATED THEREIN FOR MUSIC PLAYERS

(75) Inventor: Hideo Suzuki, Hamamatsu (JP); Emiko Suzuki, legal representative, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 11/866,817

(22) Filed: Oct. 3, 2007

(65) Prior Publication Data

US 2008/0087157 A1 Apr. 17, 2008

(30) Foreign Application Priority Data

Oct. 12, 2006 (JP) ..... 2006-278668

(51) Int. Cl.
*G10H 1/34* (2006.01)

(52) U.S. Cl. ..... 84/745; 84/18; 84/20; 84/25; 84/735; 84/743

(58) Field of Classification Search ..... None
See application file for complete search history.

(56) References Cited

U.S. PATENT DOCUMENTS

| | | | |
|---|---|---|---|
| 1,880,961 | A | 10/1932 | Kingsley |
| 2,301,184 | A | 11/1942 | Arnold |
| 3,767,833 | A | 10/1973 | Noble et al. |
| 4,527,456 | A | 7/1985 | Perkins et al. |
| 4,899,631 | A | 2/1990 | Baker |
| 4,957,029 | A | 9/1990 | Kahonen et al. |
| 4,981,457 | A | 1/1991 | Iimura et al. |
| 4,993,307 | A | 2/1991 | Sakashita |
| 5,149,904 | A | 9/1992 | Kamiya et al. |
| 5,276,272 | A | 1/1994 | Masuda |
| 5,300,729 | A | 4/1994 | Tokunaga et al. |
| 5,403,966 | A | 4/1995 | Kawashima et al. |
| 5,668,340 | A | 9/1997 | Hashizume et al. |
| 5,929,361 | A | 7/1999 | Tanaka |
| 7,049,503 | B2 | 5/2006 | Onozawa et al. |
| 7,402,738 | B2 | 7/2008 | Sawada et al. |
| 2005/0076774 | A1 | 4/2005 | Sakurada |
| 2005/0098020 | A1 | 5/2005 | Glazer |
| 2005/0126367 | A1 | 6/2005 | Bonnat |
| 2005/0145100 | A1 | 7/2005 | Ramstein |

(Continued)

FOREIGN PATENT DOCUMENTS

| | | |
|---|---|---|
| DE | 38 06 396 | 9/1989 |

(Continued)

*Primary Examiner*—Marlon T Fletcher
(74) *Attorney, Agent, or Firm*—Dickstein Shapiro LLP

(57) ABSTRACT

A supporting system is provided on a saxophone for offering assistance to the player, and includes pressure sensors monitoring the touch pieces of the keys, power assisting units equipped with torque motors provided for the keys and a controller connected to the pressure sensors and the power assisting units; a conversion table for depressed touch pieces and another conversion table for released touch pieces are prepared in the controller, and different relations between the finger force and the amount of current to be supplied to the torque motor are respectively defined in the conversion tables, respectively; the amount of current to be supplied is read out from the conversion tables depending upon the increase and decrease of finger force so that the player quickly closes the tone whole with the padded cup without curious key touch.

20 Claims, 8 Drawing Sheets

U.S. PATENT DOCUMENTS

| | | | | |
|---|---|---|---|---|
| 2005/0204906 | A1 | 9/2005 | Lengeling | |
| 2005/0217464 | A1 | 10/2005 | Onozawa et al. | |
| 2006/0090633 | A1 * | 5/2006 | Muramatsu | 84/723 |
| 2006/0185503 | A1 * | 8/2006 | Fujiwara | 84/626 |
| 2008/0017014 | A1 * | 1/2008 | Suzuki | 84/385 R |

FOREIGN PATENT DOCUMENTS

| | | | |
|---|---|---|---|
| EP | 1840869 | | 10/2007 |
| GB | 1 004 311 | | 9/1965 |
| JP | 03-091800 | A | 4/1991 |
| JP | 06-222752 | | 8/1994 |
| JP | 10254437 | A | 9/1998 |
| JP | 2001-109462 | | 4/2001 |
| JP | 2004-177828 | | 6/2004 |
| JP | 2004-334141 | | 11/2004 |
| JP | 2006-084010 | | 3/2006 |
| JP | 2006-154505 | A | 6/2006 |
| NL | 1011954 | | 11/2000 |

* cited by examiner

TB1

| PRESSURE | THE AMOUNT OF CURRENT |
|---|---|
| a1 | b11 |
| a2 | b12 |
| a3 | b13 |
| a4 | b14 |
| a5 | b15 |
| ⋮ | ⋮ |

a1<a2<a3<a4<a5
b11<b12<b13<b14<b15

TB2

| PRESSURE | THE AMOUNT OF CURRENT |
|---|---|
| a1 | b21 |
| a2 | b22 |
| a3 | b23 |
| a4 | b24 |
| a5 | b25 |
| ⋮ | ⋮ |

a1<a2<a3<a4<a5
b21<b22<b23<b24<b25

MUSICAL INSTRUMENT AND SUPPORTING SYSTEM INCORPORATED THEREIN FOR MUSIC PLAYERS

FIELD OF THE INVENTION

This invention relates to a musical instrument and, more particularly, to a musical instrument equipped with a supporting system for music players and the supporting system for making it easy to perform a music passage on the musical instrument.

DESCRIPTION OF THE RELATED ART

Musical instruments are usually designed for non-handicapped grown-up persons. Grow-up persons have their legs long enough to step on the pedals of a piano during the fingering on the keyboard. The grown-up persons are so powerful that they can quickly depress the keys of a wind instrument against the elastic force of the return springs. However, some children have their legs too short to step on the pedals of the piano. The children feel the pedals too far from their feet. Physically handicapped persons are sometimes in the situation same as that of the children in front of the musical instruments.

Various supporting apparatus and supporting systems have been proposed for the children and physically handicapped persons. One of the prior art supporting systems is disclosed in Japan Patent Application laid-open No. 2001-109462, and is hereinafter referred to as the "first prior art supporting system". The first prior art supporting system is designed for persons, who feel the pedals of standard grand pianos too far from their feet. The first prior art supporting system is fitted to the lyre post, and is provided with assistant pedals changed between their assisting positions and idling positions. While a grown-up person is playing a music passage on the grand piano, the assistant pedals are maintained at the idling positions so that the grown-up person directly steps on the pedals.

When a person, who needs the assistance, wishes to play a music passage on the grand piano, the assistant pedals are changed to the assisting positions so as to be linked with the pedals of grand piano. While the person is playing the music passage on the grand piano, the person steps on the assistant pedals for the artificial expressions. The assistant pedals make the pedals of grand piano pressed down. Thus, the person imparts the artificial expressions to the tones as if he or she directly steps of the pedals of grand piano. When the person removes the force from the assistant pedals, the pedals of grand piano are recovered to the rest positions due to the weight of component parts of the piano linked with the pedals, and, accordingly, cause the assistant pedals to return to their rest positions.

Another prior art supporting system is disclosed in Japan Patent Application laid-open No. 2004-334141, and is hereinafter referred to as the "second prior art supporting system." The second prior art supporting system is also used for a person who wishes to play a musical passage on a piano, and is portable. The second prior art supporting system aims at providing the assistance to persons who feel the pedals of the piano too far from their feet.

The second prior art supporting system is broken down into a footrest, assistant pedals and linkworks. The assistant pedals are hinged to the footrest, and are connectable to the pedals of piano by means of the associated linkworks. While the person is fingering on the keyboard without any step-on on the pedals, he or she rests the feet on the footrest. When the person wishes to impart the artificial expressions to the tones, he or she moves his or her foot from the footrest to the assistant pedal, and steps on the assistant pedal. Then, the force is transmitted from the assistant pedal through the linkwork to the pedal of piano, and makes the pedal pressed down. When the person removes the force from the assistant pedal, the pedal of piano is recovered to the rest position by virtue of the weight of component parts of the piano linked with the pedal, and causes the assistant pedal to return to the rest position.

Thus, the first prior art supporting system and second prior art supporting system fill the gap between the feet of short persons and the pedals of pianos, and assist the short persons in their performances on the pianos. However, the weakness is not taken into account. In detail, some children have their legs not only too short to step on the pedals but also too weak sufficiently to depress the assistant pedals together with the pedals of pianos. Although the first prior art supporting system and second prior art supporting system permit the children to make up the gap between their feet and the pedals of piano, it is impossible for the first prior art supporting system and second prior art supporting system to supplement the small muscular strength of children.

The above-described problem is also encountered in performances on percussion instruments such as, for example, a floor tom and on wind musical instruments such as, for example, a saxophone.

SUMMARY OF THE INVENTION

It is therefore an important object of the present invention to provide a musical instrument, which renders assistance in performance to a person who merely has the small muscular strength.

It is also an important object of the present invention to provide a supporting system, which is to be incorporated in the musical instrument.

To accomplish the object, the present invention proposes to prepare plural relations optimum to different sorts of player's intention.

In accordance with one aspect of the present invention, there is provided a musical instrument for producing music sound comprising at least one manipulator moved to different positions by player's force depending upon different sorts of player's intention so as to change an attribute of the music sound to be produced, a tone generator connected to the at least one manipulator and producing the music sound having the attribute, and a supporting system including at least one sensor provided in association with the aforesaid at least one manipulator and producing a detecting signal representative of a physical quantity expressing the movement of the aforesaid at least one manipulator, at least one actuator responsive to a driving power so as to exert assisting force causing the aforesaid at least one manipulator to move to the different positions on the aforesaid at least one manipulator and a controller connected to the aforesaid at least one sensor and the aforesaid at least one actuator, storing plural relations between the physical quantity and a magnitude of the driving power for the aforesaid at least one manipulator, selectively accessing the plural relations depending upon the different sorts of player's intention and adjusting the driving power to a certain magnitude in aforesaid selected one of the relations corresponding to the physical quantity so that the aforesaid at least one manipulator is moved by the total of the player's force and the assisting force.

In accordance with another aspect of the present invention, there is provided a supporting system for assisting a player in performance on a musical instrument comprising at least one sensor provided in association with at least one manipulator of the musical instrument and producing a detecting signal representative of a physical quantity expressing the movement of the aforesaid at least one manipulator, at least one actuator responsive to a driving power so as to exert assisting force causing the aforesaid at least one manipulator to move to different positions on the aforesaid at least one manipulator and a controller connected to the aforesaid at least one sensor and the aforesaid at least one actuator, storing plural relations between the physical quantity and a magnitude of the driving power different from one another for the aforesaid at least one manipulator, selectively accessing the plural relations depending upon different sorts of player's intention and adjusting the driving power to a certain magnitude in the aforesaid selected one of the relations corresponding to the physical quantity so that the aforesaid at least one manipulator is moved by the total of the player's force and the assisting force.

BRIEF DESCRIPTION OF THE DRAWINGS

The features and advantages of the musical instrument and supporting system will be more clearly understood from the following description taken in conjunction with the accompanying drawings, in which.

DESCRIPTION OF THE PREFERRED EMBODIMENTS

Figure 1:
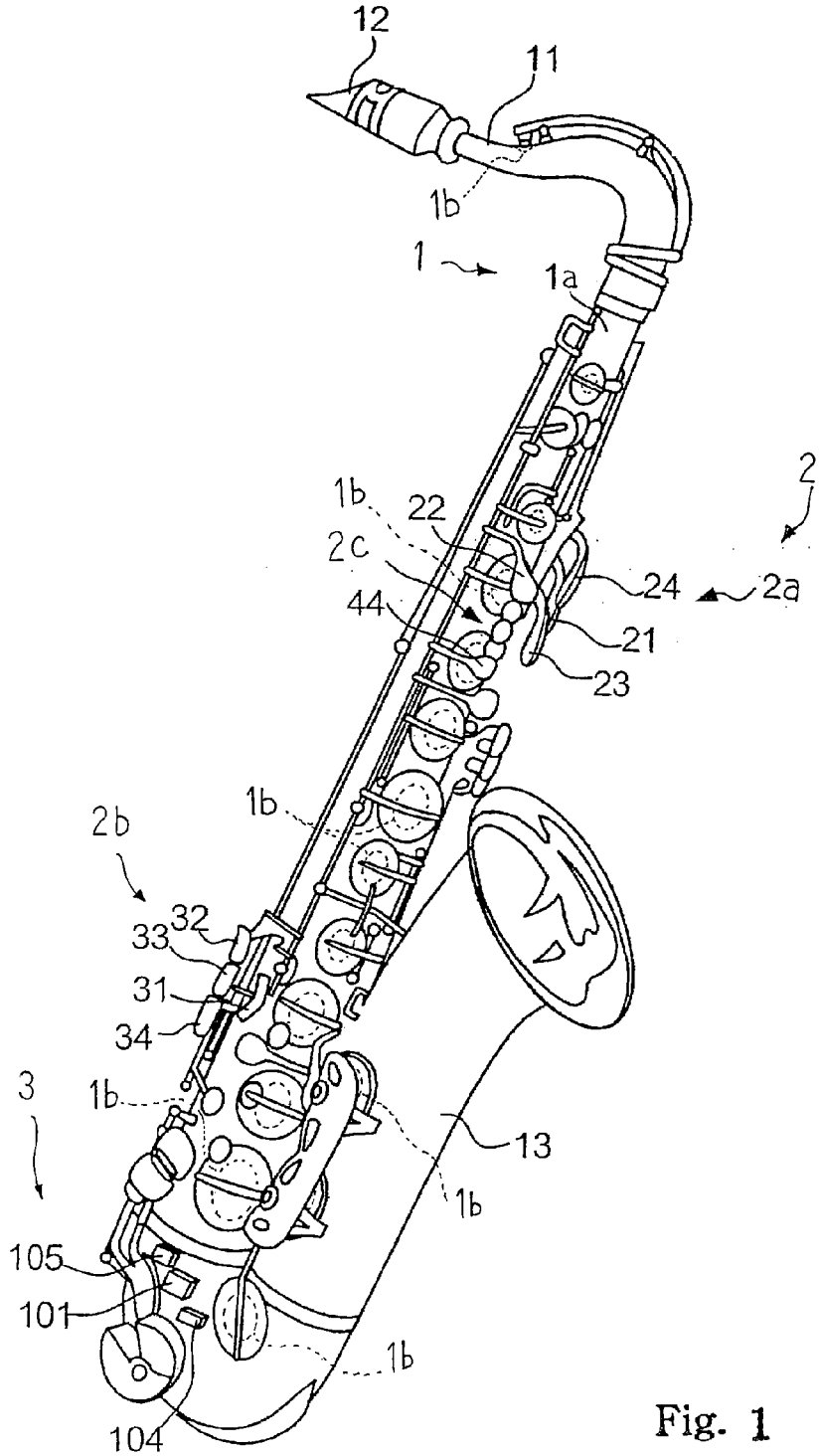
FIG. 1 is a perspective view showing a saxophone of the present invention.

A musical instrument embodying the present invention is used for producing music sound, and comprises at least one manipulator, a tone generator and a supporting system. A player moves the at least one manipulator among different positions by exerting player's force, and the position to which the at least one manipulator is moved is depending upon different sorts of player's intention. The player's intention relates to change of an attribute of the music sound. The tone generator is connected to the at least one manipulator, and produces the music sound having the attribute.

The supporting system includes at least one sensor, at least one actuator and a controller. The controller is connected to the at least one sensor and at least one actuator, and controls assisting force for assisting the player in a performance.

The at least one sensor is provided in association with the at least one manipulator, and produces a detecting signal representative of a physical quantity expressing the movement of the at least one manipulator. The detecting signal is supplied to the controller, and the controller analyzes pieces of data information carried on the detecting signal so as to determine the player's intention.

The at least one actuator is responsive to a driving power so as to exert the assisting force on the at least one manipulator. The assisting force causes the at least one manipulator to move to the different positions. Thus, the at least one manipulator is moved by the total of the player's force and the assisting force.

The controller has an information processing capability, and stores plural relations between the physical quantity and a magnitude of the driving power for the at least one manipulator. Thus, the plural relations are assigned to the at least one manipulator.

While the player is performing a piece of music on the musical instrument, the player manipulates the at least one manipulator for specifying the attribute of music sound to be produced by exerting the player's force thereon. The at least one sensor converts the player's force to the detecting signal, the magnitude of which is equivalent to the magnitude of player's force. The controller determines the player's intention, i.e., what the player intends through the movement of at least one manipulator. When the controller determines the player's intention, the controller accesses one of the plural relations prepared for the player's intention, and determines the magnitude of driving power correlated with the magnitude of physical quantity. Then, the controller adjusts the driving power to the certain magnitude, and supplies the driving signal to the at least one actuator.

When the controller acknowledges another sort of player's intention, the controller accesses another of the plural relations assigned to another sort of player's intention, and determines the magnitude of driving power from another relation.

As will be understood from the foregoing description, the plural relations are prepared for the at least one manipulator in the different sorts of player's intention. The optimum magnitude of assisting force is different among the different sorts of player's intention so that the supporting system offers the optimum assistance to the player.

First Embodiment

Referring first to FIG. 1 of the drawings, a saxophone embodying the present invention largely comprises a tubular body 1, a key mechanism 2 and a supporting system 3. A column of air is defined in the tubular body 1, and a player gives rise to vibrations of the air column in the tubular body 1. Tones are radiated from the tubular body 1 through the vibrations of air column. The key mechanism 2 is provided on the outer surface of the tubular body 1, and the player fingers on the key mechanism 2 for changing the length of air column, i.e., the pitch of the tones. The supporting system 3 is provided in association with the key mechanism 2, and assists the player in fingering on the key mechanism 2. For this reason, even if the player is weak in fingering, he or she can quickly change the pitch of tones with the assistance of the supporting system 3.

The tubular body 1 includes a conical metal tube 1*a*, a neck 11, a mouthpiece 12 with a reed and an upturned flared bell 13. Tone holes are formed in the conical metal tube 1*a*, neck 11 and upturned flared bell 13, and several tone holes are labeled with "1*b*" in FIG. 1. The mouthpiece 12 is taken in player's mouth. While the player is blowing on the mouthpiece 12, the reed gives rise to vibrations of air column in the tubular body 1.

The neck 11 is connected between the mouthpiece 12 and the conical metal tube 1*a*, and the upturned flared bell 13 is connected to the other end of the conical metal tube 1*a*. The inner space of the neck 11 is continued to the inner space of the conical metal tube 1*a*, and the inner space of conical metal tube 1*a* is continued to the inner space of the upturned flare bell 13. The upturned flared bell 13 is open to the atmosphere. Thus, the column of air is defined in the neck 11, conical metal tube 1*a* and upturned flared bell 13, and is excited in the presence of the vibrations of reed.

The key mechanism 2 includes a side key group for left hand 2*a*, a side key group for right hand 2*b* and a center key group for left hand 2*c*. A high-D key 21, a high-F key 23 and a high-Eb key 24 belong to the side key group for left hand 2*a*, and the side key group for right hand 2*b* contains a high-D trill key 31, a high-E key 32, a side C lever 33 and a side Bb lever 34. A C key 22 and an A key 44 are incorporated in the center key group for left hand 2*c*. The side keys such as the C side key 33 and Bb side key 34 are depressed with the fingers moved from the center keys thereonto before being depressed. The player usually rests his or her fingers on the center keys. For this reason, the player depresses the center keys without any movement from other keys.

Figures 2, 3A, 3B:
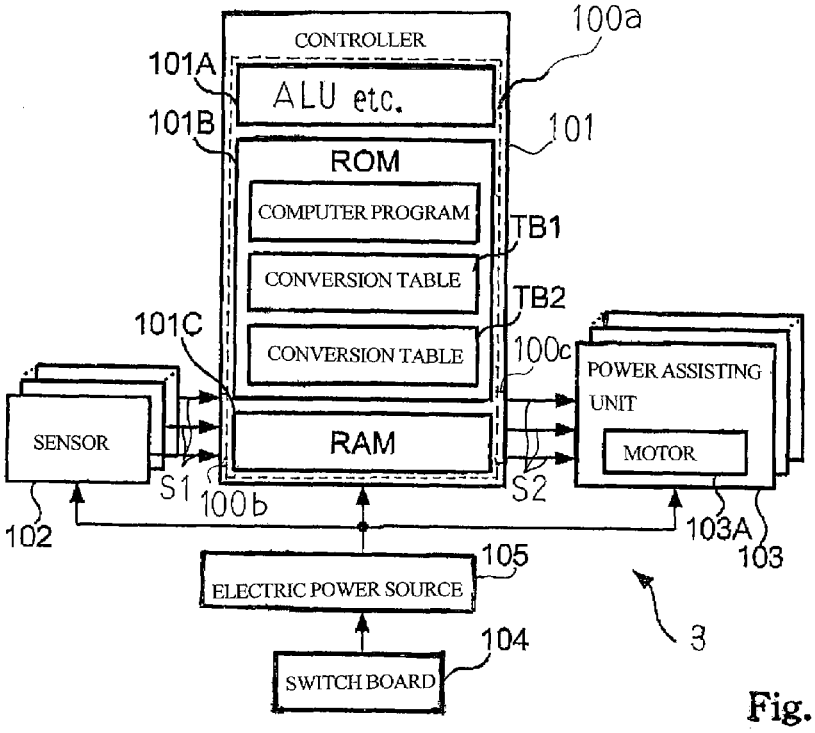
FIG. 2 is a block diagram showing the system configuration of a supporting system incorporated in the saxophone.
FIG. 3A is a view showing a relation between pressure and the amount of current stored in a conversion table.
FIG. 3B is a view showing another relation between pressure and the amount of current stored in another conversion table.

The supporting system 3 is mounted on the outer surface of the tubular body 1, and includes a controller 101, plural sensors 102, plural power-assisting units 103, a switch board 104 and an electric power source 105 as shown in FIG. 2. The electric power source 105 has power transistors connected to the controller 101 in parallel to a battery, by way of example, and the controller 101, sensors 102 and power-assisting units 103 are connected to the current-output nodes of the power transistors. In this instance, the power assisting units 103 are provided for the high-D key 21, high-F key 23 and high-Eb key 24 of the key group 2*a* for the left hand as will be here-inlater described.

The switch board 104 has an on-off switch, which is equipped with a sliding knob, and the sliding knob is moved between an on-position and an off-position. The on-off switch is connected to the control-nodes of the power transistors. While the sliding knob is staying at the off-position, the on-off switch keeps a control signal inactive, and the inactive control signals makes the power transistors turn off. On the other hand, when the sliding knob is changed to the on-position, the on-off switch changes the control signal to the active level, and the active control signal causes the power transistors to turn on. As a result, the electric power is supplied from the electric power source 105 to the controller 101, sensors 102 and power assisting units 103.

The sensors 102 are implemented by sheets of pressure-sensitive film, and are connected to the controller 101. The sheets of pressure-sensitive film are adhered to the keys of the key mechanism 2, and are varied in resistivity depending upon pressure exerted thereon. Since the electric power source 105 applies a certain potential to the sheets of pressure-sensitive film, the potential level at controller 101 is varied depending upon the pressure exerted on the sheets of pressure-sensitive film. Thus, the sensors 102 convert the pressure exerted thereon to analog detecting signals S1, respectively.

The power assisting units 103 are provided in association with the aforementioned keys 21, 23 and 24 of the key mechanism 2, and are driven with control signals S2 selectively to make the tone holes 1*b* open and closed with pads. Each of the power-assisting units 103 has a torque motor 103A, and the torque output from the torque motor 103A is under the control of the controller 101.

The controller 101 includes an information processing system 100*a*, signal input circuits 100*b* and signal output circuits 100*c*. The sensors 102 are connected in parallel to the signal input circuits 100*b*, and the signal input circuits 100*b* have analog-to-digital converters and input data buffers. The detecting signals S1 are periodically sampled, and sampled discrete values are converted to digital detecting signals representative of the pressure. The digital detecting signals are temporarily stored in the data buffers. The signal output circuits 100*c* are connected in parallel to the power assisting units 103, and have output data buffers. The control signals S2 are supplied from the output data buffers to the power assisting units 103. Though not shown, the power assisting units 103 have current driving circuits, respectively, and the current driving circuits are responsive to the control signals S2 so as to supply the electric current to the torque motors 103A. The electric current is adjusted to the amount expressed by the control signals S2.

The information processing system 100*a* is connected to the signal input circuit 100*b* and signal output circuits 100*c*. The information processing system 100*a* periodically fetches the digital detecting signals, and checks the binary numbers to see whether or not a player varies the force on the keys. While the player is keeping the pitch of tone unchanged, the answer is given negative, and the information processing system 100*a* maintains the control signals S2. On the other hand, if the player changes the depressed keys and/or released keys, the information processing system 100*a* determines the tone holes 1*b* to be closed and/or opened, and changes the control signals S2.

The information processing system 100*a* includes an arithmetic and logic unit/instruction decoder/signal control 101A, a read only memory 101B and a random access memory 101C. Although the arithmetic and logic unit/instruction decoder/signal control 101A, read only memory 101B and random access memory 101C and other system components are connected to an internal shared bus system, the other system components and internal shared bus system are not shown in FIG. 2. The arithmetic and logic unit/instruction decoder/signal control 101A, read only memory 101B and random access memory 101C are respectively abbreviated as "ALU etc.", "ROM" and "RAM" in FIG. 2.

A computer program, i.e., instruction codes and conversion tables TB1 and TB2 are stored in the read only memory 101B, and the random access memory 101C offers a working area to the arithmetic and logic unit 101A. Several registers are defined in the random access memory 101C, and pieces of pressure data and pieces of assisting power data are stored in the registers. The pieces of pressure data are indicative of the magnitude of finger force applied to the keys, and are conveyed to the signal input circuit 100*b* through the detecting signals S1. The pieces of assisting power data are indicative of the amount of current to be applied to the torque motors 103A, and are replayed to the power assisting units 103 through the control signals S2.

A relation between the pressure and the amount of current to be supplied to the torque motors 103A is expressed in the conversion table TB1, and FIG. 3A shows the relation between the pressure and the amount of current. The values a1, a2, a3, a4, a5, . . . of pressure are respectively correlated with the values b11, b12, b13, b14, b15, . . . of the amount of current in the conversion table. The pressure is stepwise increased from a1 through a2, a3, a4, a5, . . . , and the amount of current is also stepwise increased from b11, through b12, b13, b14, b15, . . . . For example, when the detecting signal S1 expresses the pressure a1, the control signal S2 is to be adjusted to b11. Another relation between the pressure and the amount of current to be supplied to the torque motors 103A is expressed in the conversion table TB2, and FIG. 3B shows the relation between the pressure and the amount of current. The values a1, a2, a3, a4, a5, . . . of pressure are respectively correlated with the values b21, b22, b23, b24, b25, . . . of the amount of current in the conversion table. When the pressure is stepwise increased from a1 through a2, a3, a4, a5, . . . , the amount of current is also stepwise increased from b21, through b22, b23, b24, b25, . . . . For example, when the detecting signal S1 expresses the pressure a1, the control signal S2 is to be adjusted to b21.

Figure 4A:
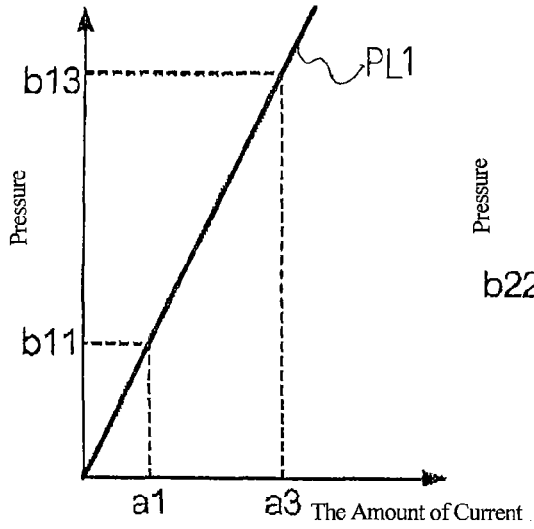
FIG. 4A is a graph showing the relation memorized in the conversion table shown in FIG. 3A.
Figure 4B:
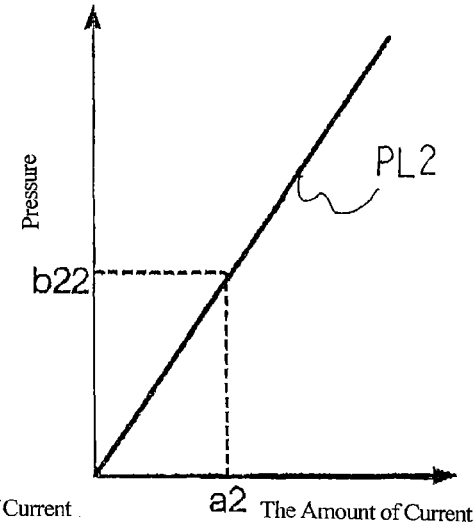
FIG. 4B is a graph showing the relation memorized in the conversion table shown in FIG. 3B.

The relation, which is memorized in the conversion table TB1, is plotted as shown in FIG. 4A. In other words, plots PL1 stands for the relation memorized in the conversion table TB1. Plots PL2 express the relation memorized in the other conversion table TB2, and are seen in FIG. 4B. The amount of current b11, b12, b13, b14, b15 are respectively greater than the amount of current b21, b22, b23, b24, b25 so that the gradient of plots PL1 is larger than the gradient of plots PL2.

When a user turns on the on-off switch on the switch board 104, the computer program starts to run on the arithmetic and logic unit 101A. While the information processing system 100*a* is being initialized, binary value "0" is written in the registers assigned to the pieces of pressure data and pieces of assisting power data.

When the user makes the power assisting units 103 active, the arithmetic and logic unit 101A periodically enters the subroutine program for the power assistance, and fetches the pieces of pressure data from the signal input circuits 100*b* in each execution of subroutine program. The arithmetic and logic unit 101A transfers the pieces of pressure data to the random access memory 101C, and stores the pieces of pressure data in the registers assigned to the sensors 102. Thus, a predetermined number of pieces of pressure data are stored in each of the registers assigned to associated one of the sensors 102.

The arithmetic and logic unit 101A periodically checks the registers to see whether or not the player increases, decreases or maintains the finger force in the subroutine program. When the arithmetic logic unit 101A confirms that the current value of the piece of power data is equal to the previous value of piece of power data, the arithmetic and logic unit 101A does not access the conversion tables TB1 and TB2, and keeps the piece of assisting power data unchanged.

When the player increases the finger force, the current value of the piece of power data is greater than the previous value of the piece of power data, the arithmetic and logic unit 101A accesses the conversion table TB1, and reads out the amount of current to be applied to the torque motor 103. The amount of current read out from the conversion table TB1 is stored in one of the registers assigned to the associated power assisting unit 103 as the piece of assisting power data, and transfers the piece of assisting power data to the signal output circuit 100*c*. The piece of assisting power data is supplied to the power assisting unit 103, and the amount of current is supplied to the torque motor 103A.

On the other hand, when the player decreases the finger force, the current value of the piece of power data becomes less than the previous value of the piece of power data, the arithmetic and logic unit 101A accesses the conversion table TB2, and reads out the amount of current to be applied to the torque motor 103. The amount of current read out from the conversion table TB2 is stored in one of the registers assigned to the associated power assisting unit 103 as the piece of assisting power data, and transfers the piece of assisting power data to the signal output circuit 100*c*. The piece of assisting power data is supplied to the power assisting unit 103, and the amount of current is supplied to the torque motor 103A.

Figure 5:
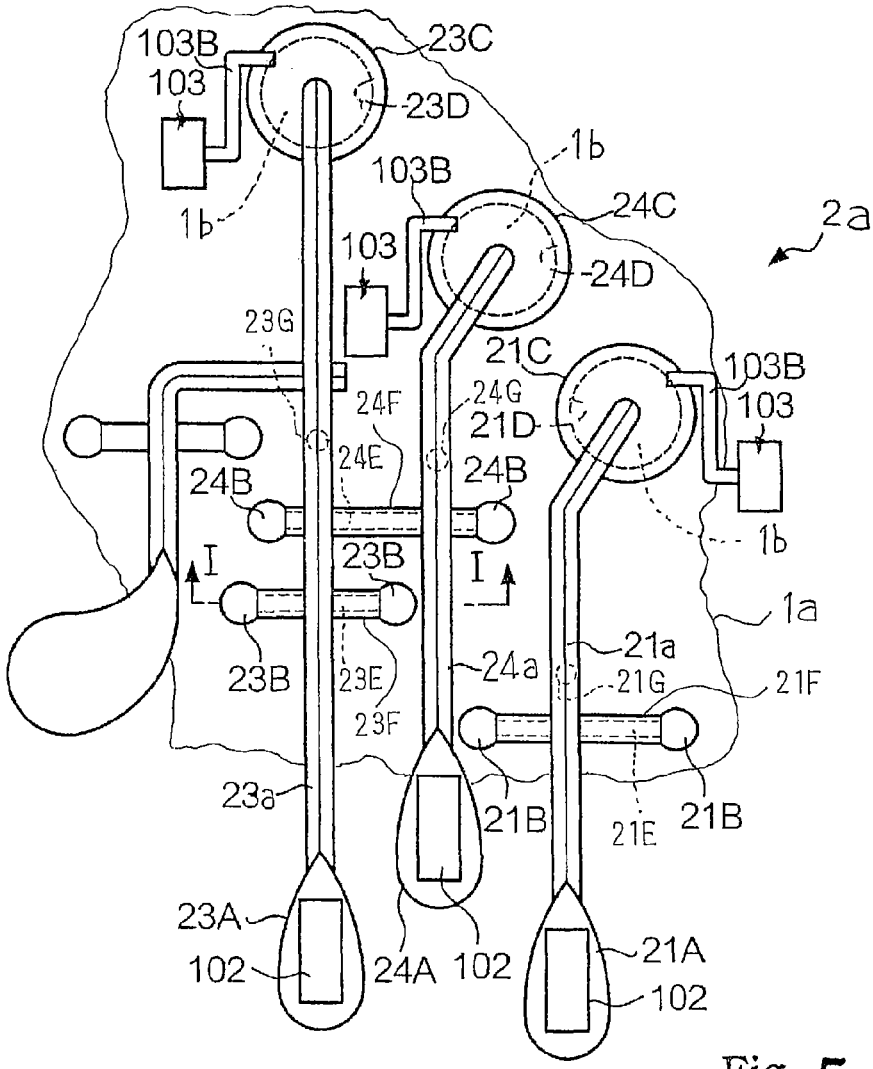
FIG. 5 is a plane view showing a part of a key mechanism incorporated in the saxophone.
Figure 6:
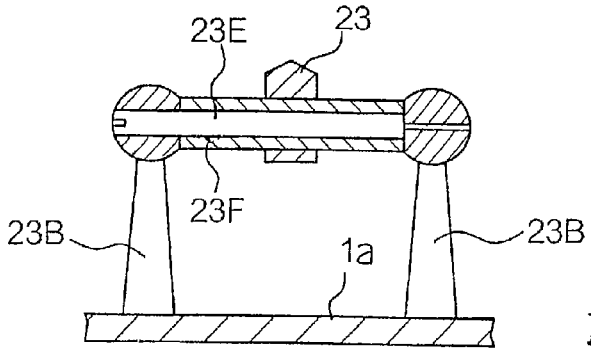
FIG. 6 is a cross sectional view taken along line I-I of FIG. 4 and showing the structure of a key.
Figure 7A:
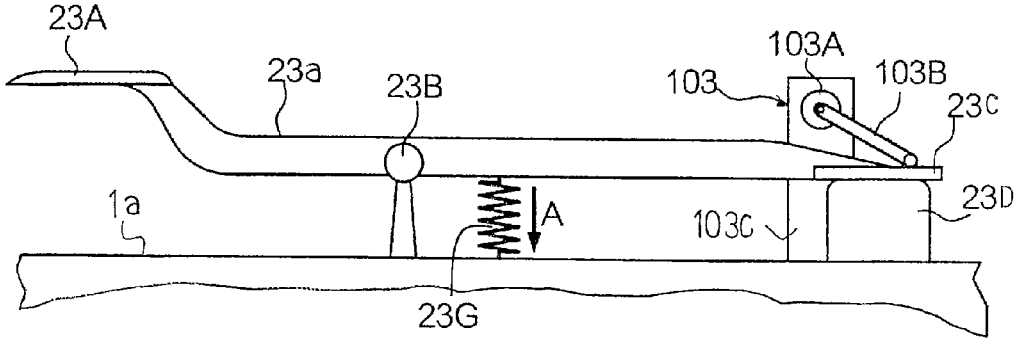
FIGS. 7A and 7B are side views showing a power assisting unit for a key at different key positions.
Figure 7B:
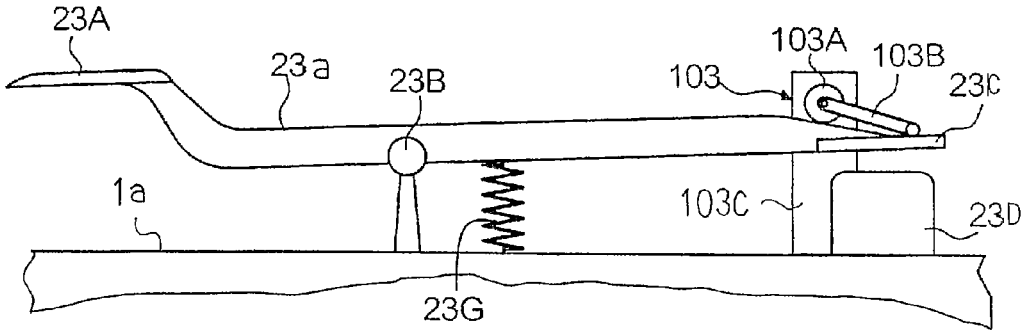

FIG. 5 shows three key sub-mechanisms incorporated in the key group for left hand 2*a* and the power assisting units 103 provided for the key sub-mechanisms. The high-D key 21, high-F key 23 and high-Eb key 24 are respectively incorporated in the sub-key mechanisms. FIG. 6 shows the cross section taken along line I-I of FIG. 4, and FIGS. 7A and 7B show the high-F key 23 viewed from the high-Eb key 24.

The tone holes 1*b* are surrounded by tone hole chimney 21D, 23D and 24D in FIG. 4, and the tone hole chimney 21D, 23D and 24D are secured to the outer surface of the conical metal tube 1*a*.

The key sub-mechanism includes a touch piece 21A, 23A or 24A, a pair of key posts 21B, 23B or 24B, the key rod 21*a*, 23*a* or 24*a*, a padded cup 21C, 23C or 24C, a rod 21E, 23E or 24E, a key sleeve 21F, 23F or 24F and a return spring 21G, 23G or 24G. As will be better seen in FIG. 6, the key posts 21B, 23B or 24B of each pair are upright on the outer surface of the conical metal tube 1*a*, and are spaced from each other. The rod 21E, 23E or 24E bridges the gap between the key posts 21B, 23B or 24B, and is secured to the key posts 21B, 23B or 24B.

The key sleeve 21F, 23F or 24F is rotatably supported by the rod 21E, 23E or 24E, and the key rod 21*a*, 23*a* or 24*a* is secured to the key sleeve 21F, 23F or 24F. The key rod 21*a*, 23*a* or 24*a* crosses the rod 21E, 23E or 24E at right angle, and is connected at one end thereof to the touch piece 21A, 23A or 24A and at the other end thereof to the padded cup 21C, 23C or 24C. The rod 21E, 23E or 24E offers an axis of rotation to the key rod 21*a*, 23*a* or 24*a* so that the key rod 21*a*, 23*a* or 24*a* pitches up and down. The padded cup 21C, 23C or 24C is provided over the tone hole chimney 21C, 23C or 24C, and is brought into contact with and spaced from the tone hole chimney 21D, 23D or 24D. Thus, the tone hole 1*b* is closed with the padded cup 21C, 23C or 24C, and is opened to the atmosphere.

The return spring 21G, 23G or 24G is provided between the outer surface of the conical metal tube 1*a* and the key rod 21*a*, 23*a* or 24*a*, and urges the key rod 21, 23 or 24 in the direction indicated by arrow A. For this reason, the padded cup 21C, 23C or 24C are held in contact with the tone hole chimney 21D, 23D or 24D at the rest position thereof, and the tone hole 1*b* is closed with the padded cup 21C, 23C or 24C. When a player wishes to open the tone hole 1*b*, he or she depresses the touch piece 21A, 23A or 24A against the elastic force of the return spring 21G, 23G or 24G. Then, the padded cup 21C, 23C or 24C is lifted over the tone hole chimney 21D, 23D or 24D, and the tone hole 1*b* is opened to the atmosphere.

The sensors 102 are respectively adhered to the touch pieces 21A, 23A and 24A, and the power assisting units 103 are respectively provided in the vicinity of the padded cups 21C, 23C and 24C. Each of the power assisting units 103 is upright on the outer surface of the conical metal tube 1*a* as shown in FIGS. 7A and 7B. The torque motor 103A is fitted to a housing 103C over the padded cup 21C, 23C or 24C, and a crank 103B is connected to the output shaft of the torque motor 103A. The other end of the crank 103B is connected to the padded cup 21C, 23C or 24C.

While the electric power is being applied to the torque motor 103A, the torque motor 103A rotates the output shaft in the counter clockwise direction in FIGS. 7A and 7B so that the elastic force of return spring 21G, 23G or 24G is partially canceled. When the total of the moment due to the force exerted on the touch piece 23A and the torque generated by the torque motor 103A exceeds the elastic force of the return spring 21G, 23G or 24G, the padded cup 21C, 23C or 24C is upwardly moved from the tone hole chimney 21D, 23D or 24D as shown in FIG. 7B, and the tone hole 1*b* is open to the atmosphere. When the total of the moment and torque becomes less than the elastic force of the return spring 21G, 23G or 24G, the return spring 21G, 23G or 24G urges the key rod 21*a*, 23*a* or 24*a* in the clockwise direction, and causes the padded cup 21C, 23C or 24C to be brought into contact with the tone hole chimney 21D, 23D or 24D as shown in FIG. 7A.

Subsequently, description is made on how the power assisting units 103 assist a player in performance on the saxophone. In the following description, the force exerted by the player with his or her fingers is hereinafter referred to as "finger force", and the moment at the padded cup 21C, 23C or 24C about the rod 21E, 23E or 24E due to the finger force is referred to as "finger moment". The moment at the padded cup 21C, 23C or 24C about the rod 21E, 23E and 24E due to the elastic force of return string 21G, 23G or 24G is hereinafter referred to as "elastic moment". The force exerted on the padded cup 21C, 23C or 24C by the torque motor 103A is referred to as "assisting force", and the moment at the padded cup 21C, 23C or 24C about the rod 21E, 23E and 24E due to the assisting force is referred to as "assisting moment". The total of finger moment and assisting moment is referred to as "resultant moment". The resultant moment forces the padded cup 21C, 23C or 24C to leave the tone hole chimney 21D, 23D or 24D. In case where the supporting system 3 is inactive, the resultant moment is equal to the finger moment. On the other hand, in case where the supporting system 3 is active, the resultant moment is equal to the total of finger moment and assisting moment.

Figure 8:
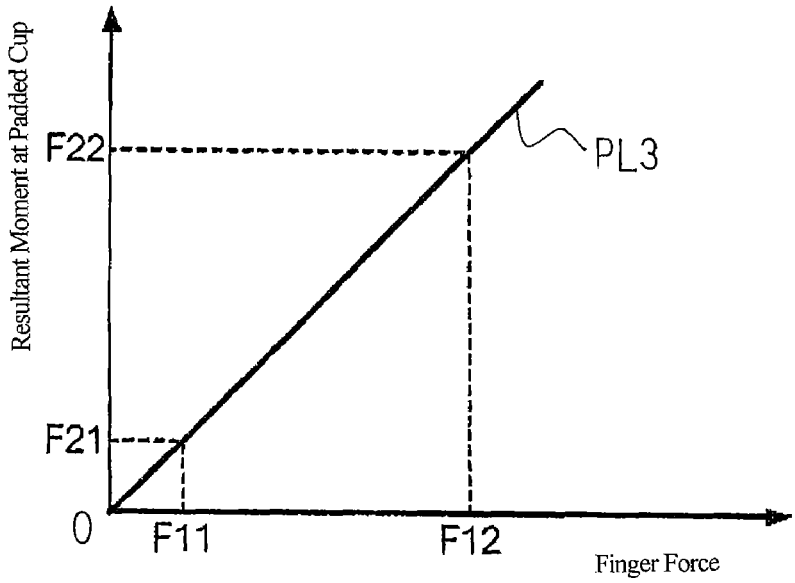
FIG. 8 is a graph showing a relation between finger force and resultant moment at a padded cup without any assistance.

FIG. 8 shows the behavior of the high-F key 23 under the condition that the on-off switch is turned off. Plots PL3 is indicative of the resultant moment at the padded cup 23C in terms of the finger force without any assistance of the power assisting unit 103. The high-F key 23 is designed in such a manner that, when the resultant moment reaches F22, the padded cup 23C starts to leave the tone hole chimney 23D.

The player is assumed to turn off the on-off switch on the switch board 104. The power transistors of the electric power source 105 remain off, and the electric power is not supplied to the sensors 102, controller 101 and power assisting units 103. The torque motor 103A does not exert any assisting force on the padded cup 23C, and the tone hole 1*b* is to be opened by the player without any assistance of the power assisting unit 103.

While the player is not forcing the touch piece 23A with his or her finger, the return spring 23G exerts the elastic force on the key rod 23*a* in the direction indicated by arrow A, and makes the padded cup 23C pressed to the tone hole chimney 23D.

The player is assumed to exert the finger force F11 on the touch piece 23A. Although the elastic moment is partially canceled with the finger moment, the tone hole 1*b* is still closed with the padded cup 23C, because the resultant moment F21 is less than the critical resultant moment F22.

The player increases the finger force on the finger piece 23A. When the finger force reaches F12, the resultant moment reaches F22, and causes the padded cup 23C to start to leave the tone hole chimney 23D. As a result, the tone hole 1*b* is opened.

When the player releases his or her finger from the touch piece 23A, the finger moment is decreased to zero, and the elastic moment causes the padded cup 23C to be brought into contact with the tone hole chimney 23D. Thus, the tone hole 1*b* is closed with the padded cup 23C.

The high-F key 23 behaves as follows on the condition that the supporting system 3 is active. Plots PL4 is indicative of the resultant moment at the padded cup 23C with the assistance of the power assisting unit 103, and the assisting force is controlled on the basis of the conversion table TB1. Plots PL5 is indicative of the resultant moment at the padded cup 23C also with the assistance of the power assisting unit 103, and the assisting force is controlled on the basis of the conversion table TB2. Plots PL3 are added to FIG. 9 so as to make the difference from plots PL4 and PL5 clear.

The player is assumed to put his or her finger on the touch piece 23A. The touch piece 23A is lightly pressed with the finger at the finger force F11, and the sensor 102 changes the detecting signal S1 to a certain potential level representative of the finger force F11. The certain potential level is converted to the digital detecting signal through the signal input circuit 100*b*, and the piece of pressure data expressed by the digital detecting signal is fetched by the information processing system 100*a*. The register assigned to the sensor 102 has been initialized so that the previous value is zero. The finger force is increased, and the information processing system 100*a* accesses the conversion table TB1. The finger force F11 is equivalent to "a1" in the conversion table TB1, and the amount of current b11 is correlated with the finger force F13 in the conversion table TB1. Therefore, the amount of current b11 is read out from the conversion table TB1, and the information processing unit 100*a* transfers the piece of power data expressing the amount of current b11 to the signal output circuit 100*c*. The signal output circuit 100*c* adjusts the control signal S2 to a certain value equivalent to the amount of current b11. The current driving circuit of the power assisting unit 103, which is associated with the high-F key 23, is responsive to the control signal S2 so that the electric current flows through the torque motor 103A at b11. The assisting force is applied to the padded cup 23C. The assisting moment is added to the finger moment, and the resultant moment reaches F23. However, the resultant moment F23 is less than F22. The padded cup 23C is still held in contact with the tone hole chimney 23D as shown in FIG. 10.

The player increases the finger force from F11 to F14. The sensor 102 increases the detecting signal S1 to another potential level expressing the finger force F14, and the detecting signal S1 is converted to the digital detecting signal expressing the finger force F14. The information processing system 100*a* fetches the piece of power data expressing the finger force F14 from the signal input circuit 100*b*. The finger force F14 is greater than the previous finger force F11 so that the information processing system 100*a* accesses the conversion table TB1, again. The finger force F14 is equivalent to a3. Then, the amount of current b13 is read out from the conversion table TB1. The information processing system 100*a* transfers the piece of power data expressing the amount of current b13 to the signal output circuit 100*c*, and the control signal S2 is adjusted to the amount of current b13. The control signal S2 is supplied to the power assisting unit 103. The amount of current is increased from b11 to b13, and, accordingly, the torque motor 103A increases the assisting force.

The total of finger moment and assisting moment becomes greater than the elastic force. In other words, the resultant moment reaches F24, which is greater than the previous resultant moment F23. For this reason, the padded cup 23C starts to leave the tone hole chimney 23D, and the padded cup 23C is spaced from the tone hole chimney 23D by gap X1, i.e., the tone hole 1*b* is opened to the atmosphere. Thus, the player changes the pitch of tone with the assistance of the power assisting unit 103.

Figure 10:
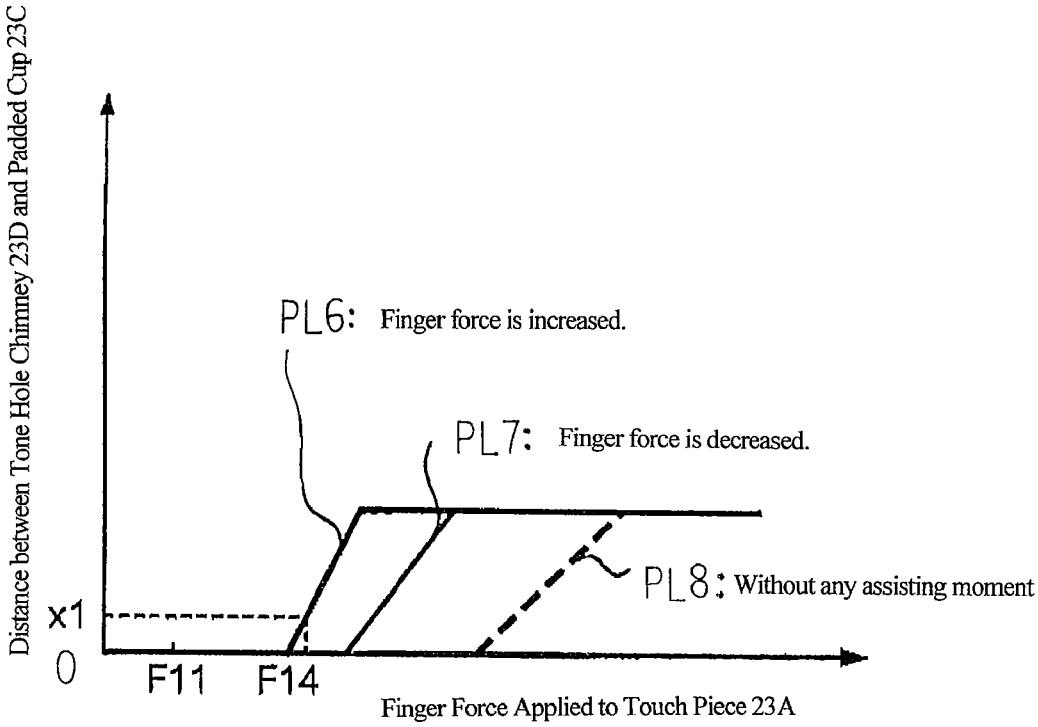
FIG. 10 is a diagram showing a relation between finger force and a gap between a padded cup and a tone hole chimney.

When the player increases the finger force, the distance between the tone hole chimney 23D and the padded cup 23C is varied as indicated by plots PL6 in FIG. 10. Comparing plots PL6 with plots PL8, which are indicative of the relation between the gap and the finger force without any assistance, it is understood that the player can space the padded cup 23C from the tone hole chimney 23D with small finger force. Thus, the player can easily perform the saxophone with the assistance of the power assisting unit 103. Even if the player is a child or a handicapped person, he or she can perform the saxophone as similar to a non-handicapped grown-up person, who performs a standard saxophone without any supporting system.

The player is assumed to wish to close the tone hole 1*b* with the padded cup 23C. The player reduces the finger force on the touch piece 23A, and the sensor 102 determines that the finger force is reduced from F14 to F15, and the detecting signal S1 representative of the finger force F15 is supplied from the sensor 102 to the signal input circuit 100*b*.

The finger force F15 is less than the previous finger force F14, and the information processing system 100*a* selects the conversion table TB2 from the read only memory 101B. The finger force F15 is equivalent to a2. The information processing system 100*a* accesses the conversion table TB2 instead of the conversion table TB1. The amount of current b22 is read out from the conversion table TB2, and the information processing system 100*a* transfers the piece of power data expressing the amount of current b22 to the signal output circuit 100*c*. The control signal S2 is adjusted to the amount of current b22, and is supplied to the power assisting unit 103. The assisting moment at the padded cup 23C is reduced, and, accordingly, the resultant moment is reduced to F25, which is less than the critical resultant moment F22. As a result, the padded cup 23C is rotated toward the tone hole chimney 23D, and is brought into contact with the tone hole chimney 23D. Thus, the tone hole 1*b* is closed with the padded cup 23C.

When the player decreases the finger force, the gap between the tone hole chimney 23D and the padded cup 23C is varied as indicated by plots PL7. Comparing the plots PL7 with the plots PL6, it is understood that the gap at a certain finger force on the plots PL7 is narrower than the gap at the certain finger force on the plots PL6. In other words, the assisting moment is rapidly reduced immediately after the player slightly reduces the finger force. The player can quickly change the tone hole 1*b*. If only the conversion table TB1 were prepared in the read only memory 101B, the power assisting unit 103 would keep the tone hole 1*b* open because of still large assisting moment exerted on the padded cup 23C. The conversion table TB2 permits the power assisting units 103 drastically to reduce the assisting moment on the padded cups at small reduction of the finger force. Thus, the supporting system 3 makes it possible to perform a rapid music passage by virtue of the conversion table TB2.

As will be understood from the foregoing description, the power assisting units 103 assist the player in the performance by increasing the moment at the padded cups 21C, 23C and 24C. Even if the player is a child or a physically handicapped person, the player feels the keys light, and can open and close the tone holes 1*b* with the assistance of the power assisting units 103. Especially, while the player is performing a fast passage on the saxophone, the player appreciates the supporting system of the present invention.

Moreover, the supporting system 3 determines the magnitude of finger force by means of the pressure sensors 102, and varies the assisting force on the padded cups depending upon the magnitude of finger force. In other words, the assisting force is not exerted on the padded cups 21C, 23C and 24C in the on-off fashion. Therefore, the player feels the key touch natural.

Since the plural conversion tables TB1 and TB2 are selectively accessed, the supporting system 3 makes it possible quickly to close the tone holes 1*b* with the padded keys 21C, 23C and 24C without serious change of key touch.

In detail, in case where a single relation or a single conversion table is used for the power assistance, following problems are encountered. The single conversion table is assumed to define the relation of the assisting moment in terms of the finger force at a large rate of change, the tone holes 1*b* are rapidly opened and closed with the padded cups like those in the on-off control, and the player feels the key-touch on the touch pieces curious. On the other hand, the single conversion table is assumed to define the relation at a small rate of change, the tone holes are 1*b* slowly closed with the padded cups, because large assisting moment is still exerted on the padded cups. As a result, the player feels it difficult to perform a rapid music passages.

On the other hand, in case where the plural conversion tables are pre-pared for the supporting system as similar to the above-described embodiment, the assisting moment is optimized depending upon player's intention in the performance on the musical instrument. The rate of change is optimized with the intention of opening the tone hole so that the player feels the key touch natural. When the player changes the intention in the performance, the conversion table to be accessed is changed from the previous one to a new one so as to optimize the relation between the finger force and the assisting moment in the new intension. For example, when the player changes the pitch of tone, the tone hole, which is now opened, is to be closed with the padded cup. The player makes the change of intention known to the supporting system by changing the finger force. In this situation, the conversion table to be assessed is changed to the new one where the relation is defined at a small range of rate. The difference in the assisting moment between the previous conversion table and the new conversion table makes the tone hole rapidly closed with the padded cup. Thus, the plural relations to be selectively used are desirable for the performance along a rapid music passage without any curious feeling on the touch pieces.

Second Embodiment

Figure 11:
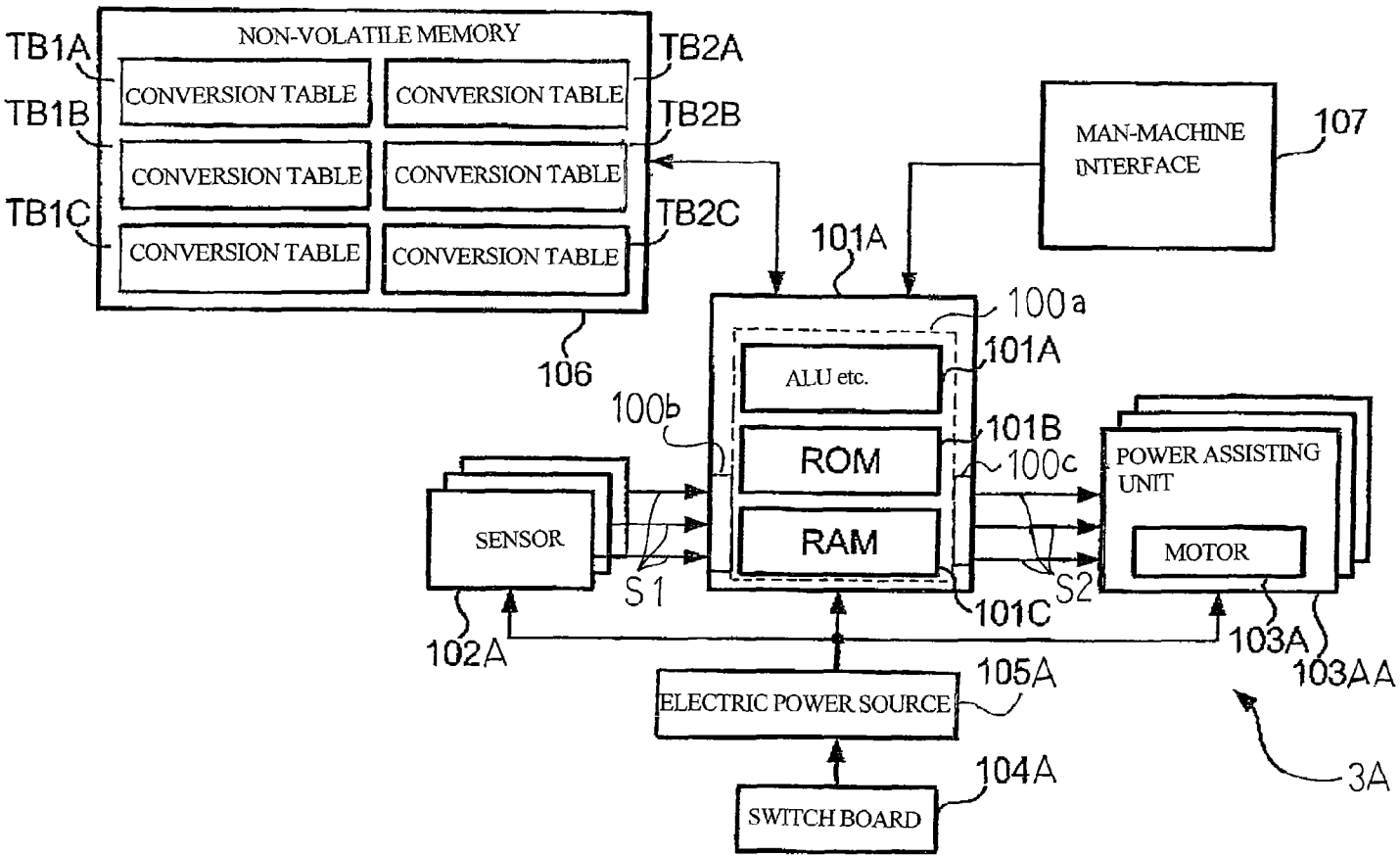
FIG. 11 is a block diagram showing another supporting system of the pre-sent invention.

Turning to FIG. 11 of the drawings, another supporting system 3A embodying the present invention largely comprises a controller 101A, plural sensors 102A, plural power assisting units 103AA, a switch board 104A, an electric power source 105, a non-volatile memory unit 106 and a man-machine interface 107. The supporting system 3A is provided in association with a saxophone (not shown). The controller 101A, sensors 102A, power assisting units 103AA, switch board 104A and electric power source 105A are similar in function to the controller 101, sensors 102, power assisting units 103, switch board 104 and electric power source 105, respectively, and, for this reason, description on the system components 101A, 102A, 103AA, 104A and 105A is omitted for avoiding repetition, and component devices thereof are labeled with the references designating the corresponding component devices in FIG. 2.

The non-volatile memory 106 is connected to the controller 101A, and memory locations in the non-volatile memory 106 are respectively assigned to plural pairs of conversion tables TB1A/TB2A, TB1B/TB2B and TB1C/TB2C. The pair of conversion tables TB1A/TB2A is used in strong power assistance, and the pair of conversion tables TB1C/TB2C is prepared for mild power assistance. The pair of conversion tables TB1B/TB2B is pertinent to players who require power assistance between the strong power assistance and the mild power assistance. The relation between the pressure and the amount of current is different between the conversion tables TB1A/TB1B/TB1C and the associated conversion tables TB2A/TB2B/TB2C as similar to the pair of conversion tables TB1 and TB2. One of the conversion tables TB1A/TB1B/TB1C is accessed while the player is increasing the finger force on the touch piece, and associated one of the conversion tables TB2A/TB2B/TB2C is accessed during the reduction of finger force.

One of the plural pairs of conversion tables TB1A/TB2A, TB1B/TB2B or TB1C/TB2C is selected from the non-volatile memory 106 through the man-machine interface 107, and the selected pair of conversion tables TB1A/TB2A, TB1B/TB2B or TB1C/TB2C is transferred from the nonvolatile memory 106 to the random access memory 101C. While the player is fingering on the keys, the information processing system 100*a* determines which conversion table of the selected pair is to be accessed for determining the amount of current as similar to that of the first embodiment.

In this instance, the man-machine interface 107 has a panel display unit and a keyboard. The information processing system 100*a* periodically checks the keys on the keyboard to see whether or not the player depresses or releases the keys. When the information processing system 100*a* acknowledges that the player has depressed a key for selecting one of the pairs of conversion tables TB1A/TB2A, TB1B/TB2B and TB1C/TB2C. The information processing system 107 produces images of the three sorts of conversion tables on the panel display unit. When the player selects a pair of conversion tables through the keyboard, the information processing system 100*a* duplicates the relations defined in the selected pair of conversion tables to the random access memory 101C, and notifies the player of the completion of the duplication.

The supporting system 3A behaves as similar to the supporting system 3 during a performance, and, accordingly, achieves all the advantages of the first embodiment. Moreover, the supporting system 3A offers the power assistance optimum to the player.

Although the particular embodiment of the present invention has been shown and described, it will be apparent to those skilled in the art that various changes and modifications may be made without departing from the spirit and scope of the present invention.

For example, the return springs 21G, 23G and 24G do not set any limit to the technical scope of the present invention. For example, sheets of resilient material such as, for example, rubber may be available for the wind musical instruments.

The high-D key 21, high-F key 23 and high-Eb key 24 do not set any limit to the technical scope of the present invention. The power assisting units 103 may be provided for the other keys or selected ones of the other keys. It is desirable to provide the power assisting unit or units 103 for heavy keys, which a baritone saxophone is equipped with, by way of example. It is also desirable to provide the power assisting unit or units 103 for keys depressed and released with the little finger or fingers.

The saxophone does not set any limit to the technical scope of the present invention. The supporting system may be provided for another sort of wind musical instrument such as, for example, a bassoon, a tuba, a clarinet and so forth.

The wind musical instrument does not set any limit to the technical scope of the present invention. A keyboard musical instrument such as, for example, a piano may be equipped with a supporting system of the present invention. Especially, a child or a physically handicapped person appreciates a supporting system of the present invention for stepping on the pedals. Another supporting system of the present invention may be provided for a foot pedal for a bass drum The supporting system may be detachable from the wind musical instrument. In this instance, when a player does not wish to be assisted with the supporting system, the supporting system is removed from the musical instrument.

The conversion tables TB1 and TB2, which defines the relation between the pressure and the amount of current do not set any limit to the technical scope of the present invention. Another supporting system may have plural conversion tables, each of which defines a relation between velocity of keys and the amount of current. In this instance, a position transducer is provided for each key, and pieces of position data are periodically fetched by the information processing system. The information processing system determines current velocity on the basis of a series of values of the piece of position data for each key, and selectively accesses the plural conversion tables. Yet another set of conversion table may define relations between acceleration of keys and the amount of current to be supplied to the motors. Thus, it is possible to determine the assisting force to be required on the basis of any sort of physical quantity which expresses movements of manipulators, i.e., the movements of keys or movements of pedals.

The amount of current does not set any limit to the technical scope of the present invention. In case where the torque motors 103A are replaced with stepping motors, conversion tables may define relations between the pressure and angle over which the output shafts of stepping motors are to rotate. Moreover, in case where the torque motors 103A are replaced with another sort of actuators, the relations define the physical quantity and another sort of energy which the actuators convert to the assistant force.

The relation between the physical quantity and the assisting force may be defined by equations, i.e., a linear function and/or non-linear functions. In this instance, the information processing system calculates the assisting force through the calculation instead of the access to the conversion tables. Thus, the conversion tables are not an indispensable feature of the present invention.

Users may rewrite the relation between the finger force and the amount of current through the man-machine interface 107.

The plural pairs of conversion tables TB1A/TB2A, TB1B/TB2B and TB1C/TB2C may be stored in the read only memory 101B instead of the non-volatile memory 106.

In the first and second embodiments, the pair of conversion tables TB1/TB2 and pairs of conversion tables TB1A/TB2A, TB1B/TB2B and TB1C/TB2C are shared among all the power assisting units 103 and units 103A. This feature does not set any limit to the technical scope of the present invention. In yet another supporting system of the present invention, plural sets of conversion tables are prepared for the keys to be power assisted or plural groups of keys. For example, a pair of conversion tables may be assigned to a key or keys depressed with a little finger. Otherwise, the keys are grouped for fingers exerted thereon, and the relations between the finger force and the amount of current are determined depending upon the strength of fingers. In this instance, the amount of current at a certain finger force in the relation for increasing the finger force is larger than the amount of current at the certain finger force in the relations stored in the other pairs of conversion tables. This is because of the fact that the little finger is weaker than the other fingers. In still another supporting system, the pair conversion tables TB1A/TB2A is assigned to the high F-key 23, and the pair of conversion tables TB1B/TB2B is assigned to the high-Eb key 24.

Time delay may be introduced between the change of finger force and the change of the amount of current. In this instance, the key touch becomes close to that of a standard saxophone.

Figure 9:
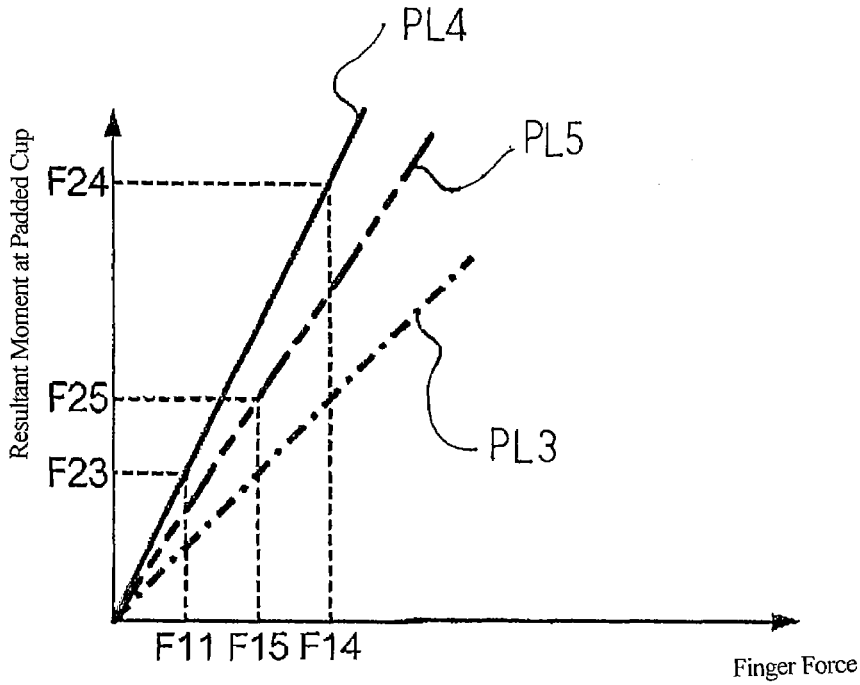
FIG. 9 is a graph showing a relation between finger force and resultant moment at a padded cup with the assistance of the supporting system of the present invention.
Figure 12:
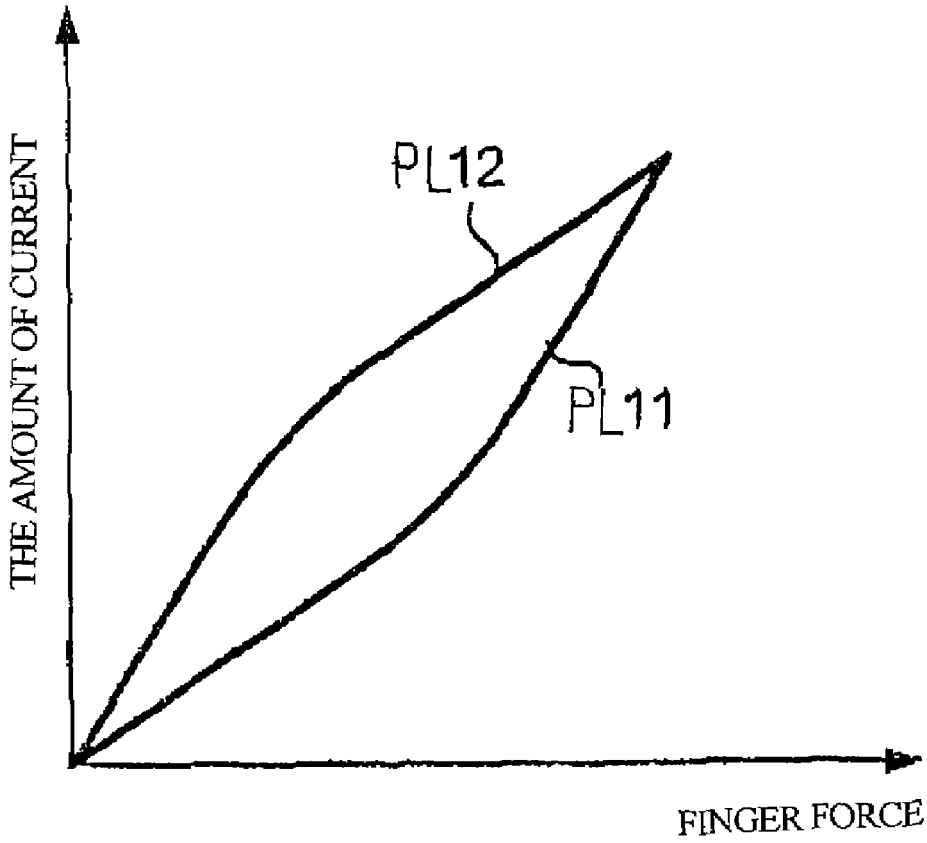
FIG. 12 is a graph showing a hysteresis of a relation between pressure and the amount of current to be supplied to power assisting units.

In FIGS. 8 and 9, the relations are expressed by linear lines. A relation between the finger force and the amount of current may be expressed by non-linear lines PL11 and PL12 as shown in FIG. 12. The electric motors 103A do not set any limit to the technical scope of the present invention. Another sort of actuators is available for the supporting system of the present invention. For example, the torque motors 103A may be replaced with ultrasonic motors. The ultrasonic motors may move the touch pieces or rods between the touch pieces and the padded cups. The solenoid-operated reciprocal actuators are also available for the supporting system of the present invention.

The on-off switches may be individually provided for the power assisting units 103/103A. In this instance, when a player wishes to assist the fingering on a certain key, he or she turns on the on-off switch assigned to the power assisting unit 103/103A for the certain key. While the on-off switches remain off, any power assist is not offered.

The return springs 21G, 23G and 24G may be removed from the musical instrument 1. In this instance, the tone holes 1*b* are opened and closed with the padded cups 21C, 23C and 24C by means of the torque motors 103. In this instance, the tone holes 1*b* are rapidly opened, because the assistant moment is not partially canceled with the elastic moment.

In the embodiments described hereinbefore, two relations are selectively accessed depending upon the increase and decrease of the finger force. This feature does not set any limit to the technical scope of the present invention. More than two relations may be prepared for the keys or pedals. For example, while a player is keeping a tone hole open, the finger force is unchanged or delicately varied. In this situation, the information processing unit accesses the third relation, and maintains the padded cup at a certain position regardless of the varied finger force. In case where a supporting system of the present invention is provided for pedals of a piano, a player keeps the damper pedal at the half pedal position. In this situation, a relation between the foot force and the amount of current is prepared for the half pedal position in addition to the relation for increased foot force and the relation for decreased foot force. Thus, the different relations are to be equal in number to the different sorts of player's intention.

The components of the supporting systems 3 and 3A are correlated with claim languages as follows. The high-D key 21, high-F key 23 or high-Eb key 24 serves as "at least one manipulator", and the closed position and open position of the padded cup 21C, 23C or 24C are "different positions". The tubular body 1, which the tone holes 1*b* are formed in, and key mechanism 2 except for the keys 21, 23 and 24 as a whole constitute "a tone generator", and the pitch is "an attribute of music sound". Player's intention to close the tone hole 1*b* is "one of the different sorts of player's intention", and player's intention to open the tone hole 1*b* is "another of the different sorts of player's intention". One of the pressure sensors 102/102A is corresponding to "at least one sensor", and one of the power assisting units 103/103AA is corresponding to "at least one actuator". The plots PL4 and P15 define "plural relations", and the finger force is "a physical quantity". The amount of current makes the at least one actuator generate "assisting force".

What is claimed is:

1. A musical instrument for producing music sound, comprising:

at least one manipulator moved to different positions by player's force depending upon different sorts of player's intention so as to change an attribute of the music sound to be produced;

a tone generator connected to said at least one manipulator, and producing said music sound having said attribute; and a supporting system including at least one sensor provided in association with said at least one manipulator and producing a detecting signal representative of a physical quantity expressing the movement of said at least one manipulator, at least one actuator responsive to a driving power so as to exert an assisting force on said at least one manipulator causing said at least one manipulator to move to said different positions, and a controller connected to said at least one sensor and said at least one actuator, said controller storing plural relations between said physical quantity and a magnitude of said driving power, said controller selectively accessing said plural relations depending upon said different sorts of player's intention and adjusting said driving power to a certain magnitude in said selected one of said relations corresponding to said physical quantity so that said at least one manipulator is moved by the total of said player's force and said assisting force.

2. The musical instrument as set forth in claim 1, in which one of said different sorts of player's intention makes said at least one manipulator to move from one of said different positions to another of said different positions, and another of said different sorts of players intention makes said at least one manipulator to move from said another of said different positions to said one of said different positions.

3. The musical instrument as set forth in claim 2, in which the movement from said one of said different positions to said another of said different positions causes said music sound to be changed from a pitch to another pitch, and the movement from said another of said different positions to said one of said different positions causes said music sound to be changed from said another pitch to said pitch.

4. The musical instrument as set forth in claim 2, in which said player's force is increased so as to cause said at last one manipulator to open a tone hole of said tone generator through the movement from said one of said different positions to said another of said different positions, and is decreased so as to cause said at least one manipulator to close said tone hole through the movement from said another of said different positions to said one of said different positions.

5. The musical instrument as set forth in claim 4, in which values of said magnitude of driving power at certain values of said physical quantity in the relation accessed in said movement from said one of said different positions to said another of said different positions are greater than values of said magnitude at said certain values of said physical quantity in the relation accessed in said movement from said another of said different positions to said one of said different positions, respectively.

6. The musical instrument as set forth in claim 5, in which said relations accessed in said movements between said one of said different positions and said another of said different positions are expressed by linear plots.

7. The musical instrument as set forth in claim 5, in which said relations accessed in said movements between said one of said different positions and said another of said different positions are expressed by non-linear plots.

8. The musical instrument as set forth in claim 1, in which other sets of relations are further stored in said controller for defining said magnitude of said driving power in terms of said physical quantity, and values of the magnitude of said driving power at certain values of said physical quantity in said plural relations are different from values of said magnitude of said driving power at said certain values of said certain physical quantity in one of said other sets of relations.

9. The musical instrument as set forth in claim 8, in which said plural relations and said other sets of relations are selectively assigned to said at least one manipulator and other manipulators used for the purpose same as said at least one manipulator.

10. The musical instrument as set forth in claim 1, in which said tone generator has a tubular body formed with tone holes and a linkwork provided on said tubular body and connected to said at least one manipulator and other manipulators, and said tone holes are opened and closed by means of said at least one manipulator and said other manipulators.

11. The musical instrument as set forth in claim 10, in which said player's force is increased on said at least one manipulator and said other manipulators so as to open said tone holes, and is decreased so as to close said tone holes.

12. The musical instrument as set forth in claim 11, in which one of said plural relations and another of said plural relations are respectively assigned to the increase of said player's force and the decrease of said player's force, respectively.

13. The musical instrument as set forth in claim 1, in which said at least one sensor converts pressure on said at least one manipulator to said detecting signal so that said plural relations defines said magnitude of driving power in terms of said pressure.

14. A supporting system for assisting a player in performance on a musical instrument, comprising:

at least one sensor provided in association with at least one manipulator of said musical instrument, and producing a detecting signal representative of a physical quantity expressing the movement of said at least one manipulator;

at least one actuator responsive to a driving power so as to exert an assisting force on said at least one manipulator causing said at least one manipulator to move to different positions; and a controller connected to said at least one sensor and said at least one actuator, storing plural relations between said physical quantity and a magnitude of said driving power different from one another, said controller selectively accessing said plural relations depending upon different sorts of player's intention, and adjusting said driving power to a certain magnitude in said selected one of said relations corresponding to said physical quantity so that said at least one manipulator is moved by the total of said player's force and said assisting force.

15. The supporting system as set forth in claim 14, in which one of said different sorts of player's intention makes said at least one manipulator to move from one of said different positions to another of said different positions, and another of said different sorts of players intention makes said at least one manipulator to move from said another of said different positions to said one of said different positions.

16. The supporting system as set forth in claim 15, in which the movement from said one of said different positions to said another of said different positions causes music sound to be changed from a pitch to another pitch, and the movement from said another of said different positions to said one of said different positions causes said music sound to be changed from said another pitch to said pitch.

17. The supporting system as set forth in claim 15, in which said player's force is increased so as to cause said at last one manipulator to open a tone hole of said tone generator through the movement from said one of said different positions to said another of said different positions, and is decreased so as to cause said at least one manipulator to close said tone hole through the movement from said another of said different positions to said one of said different positions.

18. The supporting system as set forth in claim 17, in which values of said magnitude of driving power at certain values of said physical quantity in the relation accessed in said movement from said one of said different positions to said another of said different positions are greater than values of said magnitude at said certain values of said physical quantity in the relation accessed in said movement from said another of said different positions to said one of said different positions, respectively.

19. The supporting system as set forth in claim 14, in which other sets of relations are further stored in said controller for defining said magnitude of said driving power in terms of said physical quantity, and values of the magnitude of said driving power at certain values of said physical quantity in said plural relations are different from values of said magnitude of said driving power at said certain values of said certain physical quantity in one of said other sets of relations.

20. The supporting system as set forth in claim 19, in which said plural relations and said other sets of relations are selectively assigned to said at least one manipulator and other manipulators used for the purpose same as said at least one manipulator.

* * * * *